US009132563B2

(12) United States Patent
Reifenhaeuser

(10) Patent No.: US 9,132,563 B2
(45) **Date of Patent: *Sep. 15, 2015**

(54) METHOD FOR CUTTING A LOAF-SHAPED FOOD USING A CUTTING MACHINE

(76) Inventor: Uwe Reifenhaeuser, Flammersfeld (DE)

( * ) Notice: Subject to any disclaimer, the term of this patent is extended or adjusted under 35 U.S.C. 154(b) by 1397 days.

This patent is subject to a terminal disclaimer.

(21) Appl. No.: 12/395,804

(22) Filed: Mar. 2, 2009

(65) Prior Publication Data

US 2010/0050833 A1 Mar. 4, 2010

(30) Foreign Application Priority Data

Feb. 29, 2008 (DE) ..... 10 2008 011 980

(51) Int. Cl.
*B26D 1/01* (2006.01)
*B26D 7/01* (2006.01)
*B26D 7/06* (2006.01)

(52) U.S. Cl.
CPC ..... *B26D 7/018* (2013.01); *B26D 7/0683* (2013.01); *B26D 2210/02* (2013.01); *Y10S 83/932* (2013.01); *Y10T 83/04* (2015.04); *Y10T 83/0538* (2015.04); *Y10T 83/654* (2015.04); *Y10T 83/6518* (2015.04); *Y10T 83/6657* (2015.04); *Y10T 83/748* (2015.04)

(58) Field of Classification Search
CPC .. B26D 7/018; B26D 7/0683; B26D 2210/02; B23B 31/30; B23B 31/302; B23B 31/307; B23Q 5/22; B25B 11/005; B25B 11/007; Y10S 83/932; Y10T 83/04; Y10T 83/0538; Y10T 83/6518; Y10T 83/654; Y10T 83/6657; Y10T 83/6659; Y10T 83/748
USPC ..... 83/409, 277, 278, 42, 276, 437.2, 451, 83/932; 414/18
IPC ..... B26D 7/018,7/0683, 2210/01
See application file for complete search history.

(56) References Cited

U.S. PATENT DOCUMENTS

| | | | |
|---|---|---|---|
| 3,880,295 | A | 4/1975 | Wyslotsky |
| 3,894,457 | A | 7/1975 | Miller et al. |
| 4,015,494 | A | 4/1977 | Spooner et al. |

FOREIGN PATENT DOCUMENTS

| | | | |
|---|---|---|---|
| DE | 80 07 660 | U1 | 1/1984 |
| DE | 100 24 913 | A | 11/2001 |
| DE | 102005010184 | | 9/2006 |
| EP | 1 400 324 | A | 3/2004 |

*Primary Examiner* — Clark F Dexter
(74) *Attorney, Agent, or Firm* — Von Rohrscheldt Patents

(57) ABSTRACT

A food loaf is advanced toward a cutting device by a feed apparatus and the loaf is cut into slices, strips or cubes by the cutting device such that the loaf is fixed during the feed movement by a vacuum gripper that is advanced together with the loaf and a negative pressure is generated within an interior of a contact element of the vacuum gripper and acts upon a fixing region of the surface of the loaf in a suction region of the contact element. In order to avoid a vacuum loss, it is proposed that the suction region is divided into at least two separate partial suction regions and the interior of the contact element is accordingly divided into at least two partial interiors, wherein the partial suction regions respectively adjoin one another, are separated from by a contact line and form separate partial fixing regions.

3 Claims, 3 Drawing Sheets

METHOD FOR CUTTING A LOAF-SHAPED FOOD USING A CUTTING MACHINE

CROSS-REFERENCES TO RELATED APPLICATIONS

This application claims the priority of German Patent Application Serial No. DE 10 2008 011 980.6, filed Feb. 29, 2008 pursuant to 35 U.S.C. 119(a)-(d), the subject matter of which is incorporated herein by reference.

BACKGROUND OF THE INVENTION

The invention refers to a method for cutting a food, in particular, a loaf-shaped food, in which a loaf of the food is advanced toward a cutting device by means of a feed apparatus and cut into slices, strips or cubes by said cutting device.

The invention also refers to a cutting machine for cutting a loaf-shaped food that makes it possible to cut a loaf of the food into slices, strips or cubes and features a feed apparatus for advancing the loaf toward the cutting device during the cutting process, A method and a cutting machine of the above-described type are generally known. As compared to the utilization of gripping hooks, fixing of the loaf by means of a vacuum gripper provides the advantage that the loaf itself remains undamaged because its surface is not permanently changed by the contact element of the vacuum gripper. In the known methods and cutting machines, the negative pressure is generated with the aid of so-called vacuum pumps. The negative pressure is transmitted from the vacuum pump to the interior of the contact element through a line. The contact element itself typically consists of a rubber collar of sorts that is intended to compensate for uneven areas and irregularities on the surface of the loaf due to its elastic properties in order to prevent the admission of air into the suction region of the rubber collar after the negative pressure is applied. During the cutting mode of the known machines, the vacuum pumps used typically operate continuously such that they do not have to be switched on and off between the cutting of two successive loafs, wherein the continuously operating vacuum pumps also compensate possible leaks in the region of the contact element that would allow ambient air to flow into the interior of the contact element and permanently maintain a sufficiently high negative pressure.

In order to solve the above-described problem, it is known to fit the contact element of the vacuum gripper with a blade that cuts into the loaf such that a seal is produced in the suction region. For example, DE 100 24 913 A1 discloses a cutting machine of the type described above, wherein the feed apparatus which comprises at least one "suction cup" that defines a negative pressure chamber, such that this negative pressure chamber is open toward the loaf. The suction cup features a blade-shaped edge that is intended to ensure a very tight connection between the suction cup and the product loaf.

U.S. Pat. No. 3,880,295 A also describes a cutting machine featuring a suction head with six suction regions that are arranged linearly adjacent to one another and equipped with blades that dig into the face to be fixed of a product being cut. In this case, each individual suction region is formed by an annular space between an inner blade and an outer blade extending concentric thereto. No suction region is arranged within the inner blade. The circular ring-shaped suction area of U.S. Pat. No. 3,880,295 A is thus sealed in each case towards the outside as well as towards the inside by means of a cutting edge.

Depending on the consistency of the surface of the loaf and the condition of the rubber collar of the contact element, however, leakage problems still occur in known vacuum grippers such that the vacuum is lost or the negative pressure is not sufficiently high for reliably fixing the loaf on the vacuum gripper. This leads to undesirable transverse displacements of the loaf during the advancing and cutting process that, in turn, result in an insufficiently accurate geometry of the produced slices, strips or cubes.

It would therefore be desirable and advantageous to provide an improved method for cutting a loaf-shaped food, as well as a corresponding cutting machine, in which the risk of losing or excessively reducing the vacuum in the contact element of the vacuum gripper is lowered.

SUMMARY OF THE INVENTION

According to one aspect of the present invention, a cutting method includes that the suction region is divided into at least two separate partial suction regions and the interior of the contact element is accordingly divided into at least two partial interiors, wherein the partial suction regions respectively adjoin one another and are separated from one another by a contact line and form separate partial fixing regions on the surface of the loaf.

The present invention resolves prior art problems by increasing the safety during the fixing process, such that at least two separate partial suction regions are created, because the vacuum in the at least one other partial suction region is still available if the vacuum in a partial suction region is lost such that at least a residual fixing force for the loaf is still available. The vacuum typically fails due to a rather singular irregularity in the surface consistency of the loaf such that the pressure in the other partial suction region remains intact if a partial suction region develops a leak.

The method for cutting a loaf-shaped food includes advancing the loaf of the food toward a cutting device by means of a feed apparatus for cutting into slices, strips or cubes by said cutting device, wherein during the feed movement the loaf is fixed by means of a vacuum gripper advanced together with the loaf, and wherein a negative pressure is generated within an interior of a contact element of the vacuum gripper which acts upon at least one fixing region of the surface of the loaf in at least one suction region of the contact element; and dividing the suction region into at least two separate partial suction regions and dividing the interior of the contact element accordingly into at least two partial interiors wherein the partial suction regions respectively adjoin one another, are separated from one another by a contact line and form separate partial fixing regions.

The strict structural separation of the individual partial interiors from one another is important for the proper function of the inventive method because two connected partial interiors would communicate with one another such that a vacuum loss in one partial interior would also lead to a corresponding vacuum loss in the other partial interior(s)—at least after brief equalization processes have taken place. For example, it is necessary to utilize two vacuum pumps, i.e., one respective vacuum pump for a partial interior or a partial suction region, if the negative pressure should be generated in this fashion. If the negative pressure is generated by means of a piston-cylinder unit, it is necessary to utilize two such piston-cylinder units or a double piston or step piston in order to separate the partial interiors from one another structurally and with respect to the pressure.

It is preferred that all partial fixing regions of the surface of the food that are formed by the partial suction regions are acted upon with a negative pressure of the same intensity in order to prevent irregular deformations of the loaf that propagate over its entire length up to the opposite cutting length and can lead to irregular cutting geometries at this location.

The partial suction regions can be shielded relative to one another particularly well if a partial fixing region formed by an inner partial suction region is acted upon with a negative pressure of a first intensity and a partial fixing region formed by an adjacent outer partial suction region that encloses the inner partial suction region is acted upon with a negative pressure of a second intensity, wherein the first negative pressure is higher than the second negative pressure. Due to these measures, high negative pressures and therefore high retaining forces can be generated in the inner partial suction region via the respective boundaries between the partial suction regions at small pressure differentials.

Based on a cutting machine of the initially described type, the objective of the invention is attained, according to the invention, in that the suction region is divided into at least two separate partial suction regions and the interior of the contact element is accordingly divided into at least two separate partial interiors, wherein the partial suction regions respectively adjoin one another, are separated from one another by a contact line and form separate partial fixing regions on the surface of the loaf.

In one preferred embodiment of the inventive cutting machine, one partial suction region is completely enclosed by another partial suction region such that the separating contact line that is in tight contact with the surface of the loaf forms a closed curve. In this case, the first partial suction region may be realized circularly and at least one other partial suction region may annularly enclose the first partial suction region. It would also be possible to realize a staggered and concentric arrangement of several outer annular partial suction regions. Alternatively, it would also be conceivable to divide an annular partial suction region into several partial suction regions by means of one or more radially extending webs.

An advantageous additional development of the inventive cutting machine consists of an attachment that is fixed on the vacuum gripper, wherein the contact element and the at least two partial suction regions are realized on the front side of said attachment that points in the feed direction, and wherein the attachment can be separated from the vacuum gripper and all partial suction regions extend from the attachment into the vacuum gripper in a sealed and mutually separated fashion in the mounted state of the attachment. Due to these measures, the geometry of the at least two partial suction regions can be adapted to the geometry of the loaf to be currently fixed.

The invention is described in greater detail below with reference to one embodiment of a vacuum gripper of a cutting machine that is illustrated in the drawings.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
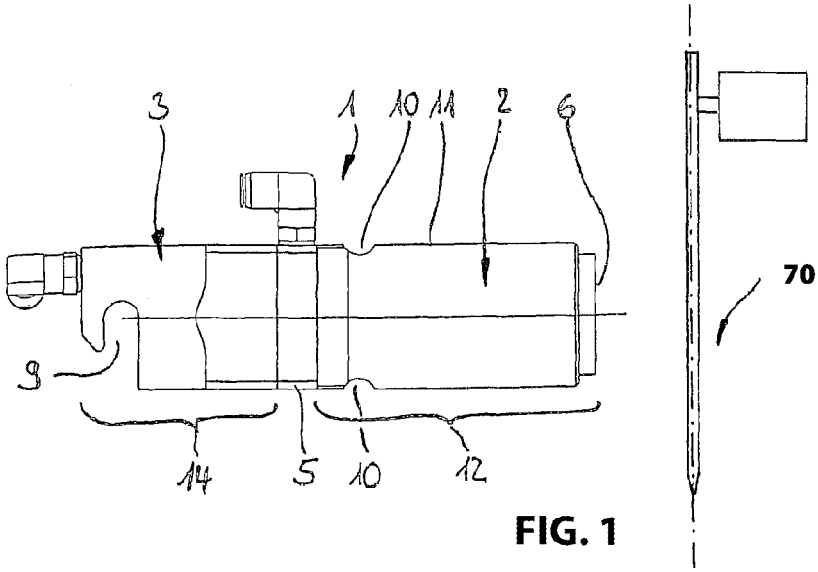
FIG. 1 is an elevational side view of a vacuum gripper according to the present invention.
Figure 2:
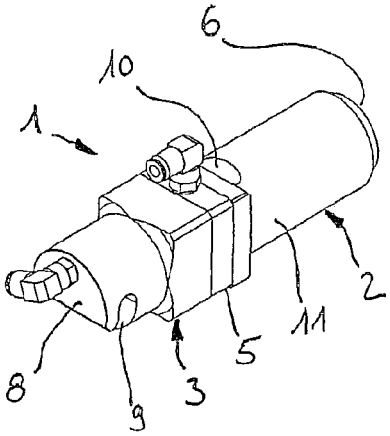
FIG. 2 shows a perspective representation of a vacuum gripper in the form of an oblique front view.

Throughout all the Figures, same or corresponding elements are generally indicated by same reference numerals.

Turning now to the drawing, and in particular to FIG. 1 to FIG. 5*b*, there is shown a vacuum gripper 1 consisting of two coaxially arranged piston-cylinder units 2 and 3 that are coupled to one another by means of a common piston rod 4 and separated from one another by a partition wall 5, in which the piston rod 4 is supported in a sliding and sealed fashion.

Figure 3:
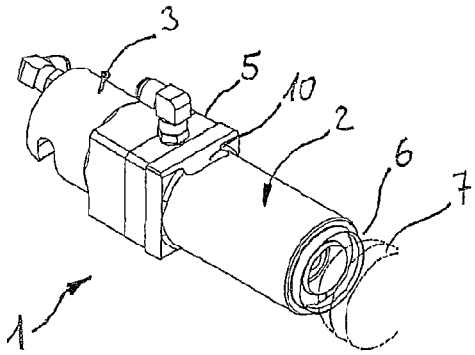
FIG. 3 shows a perspective representation of the vacuum gripper according to FIG. 2 in the form of an oblique rear view.
Figure 4:
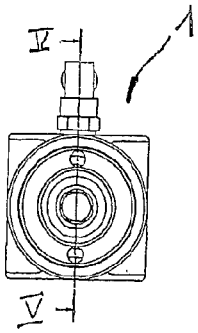
FIG. 4 shows a rear elevational view of the vacuum gripper according to FIGS. 1 to 3.
Figure 7:
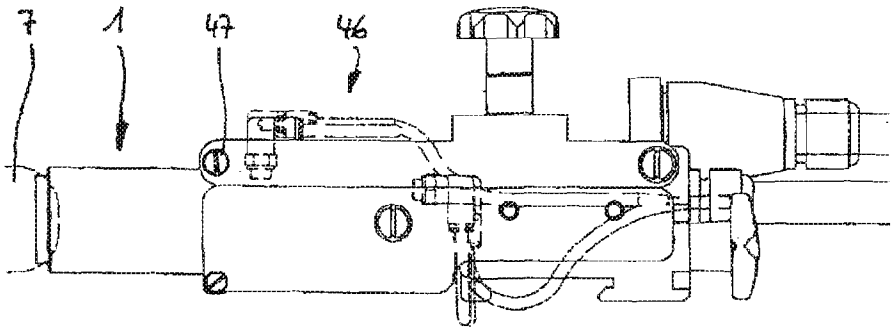
FIG. 7 shows a side view of the gripping device according to FIG. 6.
Figure 8:
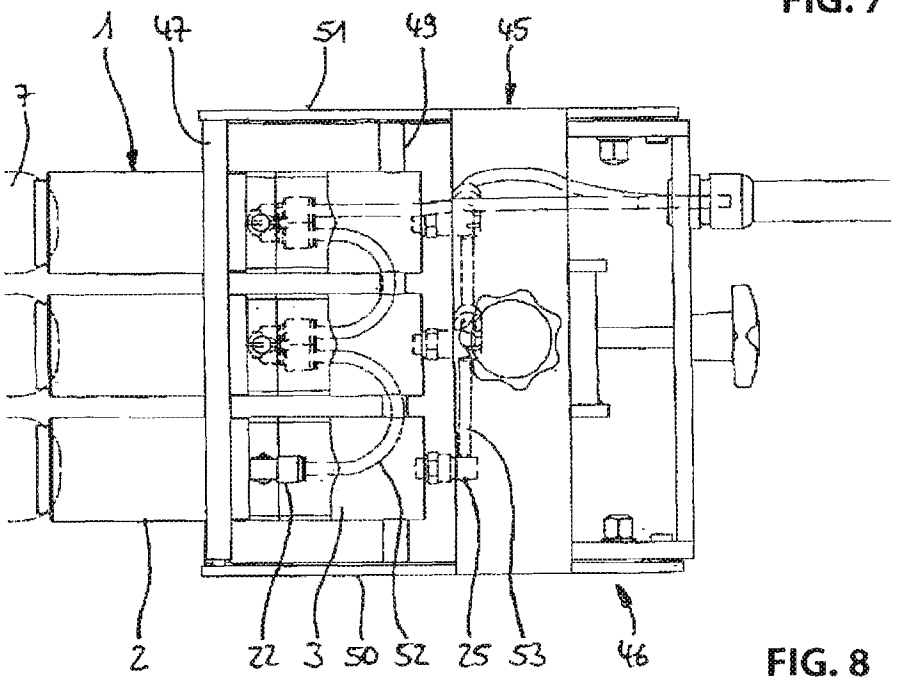
FIG. 8 shows a top view of the gripping device according to FIG. 6.
Figure 6:
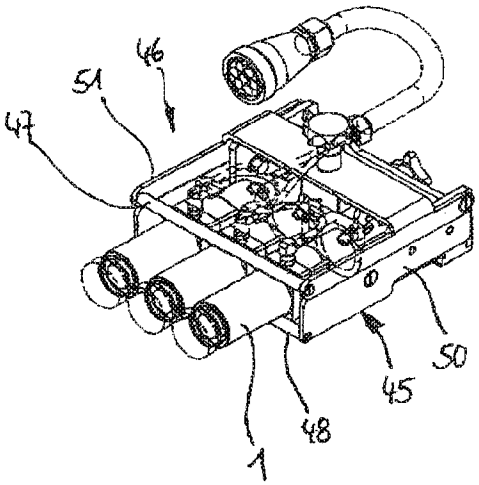
FIG. 6 shows a perspective representation of a gripping device that comprises a base frame and three vacuum grippers according to FIGS. 1 to 5 supported therein.

The vacuum gripper 1 has a front side 6, to which a product string 7 illustrated in a dashed manner in FIG. 3, for example in the form of a pork sausage, is fixed by means of a vacuum in a manner, which will be described in more detail hereinbelow. On the opposite end, the vacuum gripper 1 has a rear side 8, on which it can be fixed on a base frame 45 of a gripping device that is illustrated in FIGS. 6 to 8 and described in greater detail below with the aid of a slot-shaped recess 9. The mounting is furthermore achieved with two groove-shaped recesses 10 in an outside surface 11 of the vacuum gripper 1.

Adjacent to the partition wall 5, the vacuum gripper 1 features a front section 12 that is formed by the piston-cylinder unit 2 and serves for generating the negative pressure for fixing the loaf 7. The oppositely arranged rear section 14 is essentially formed by another piston-cylinder unit 3 that serves for driving a piston 28 of the piston-cylinder unit 2 situated in the front section 12.

Figure 5A:
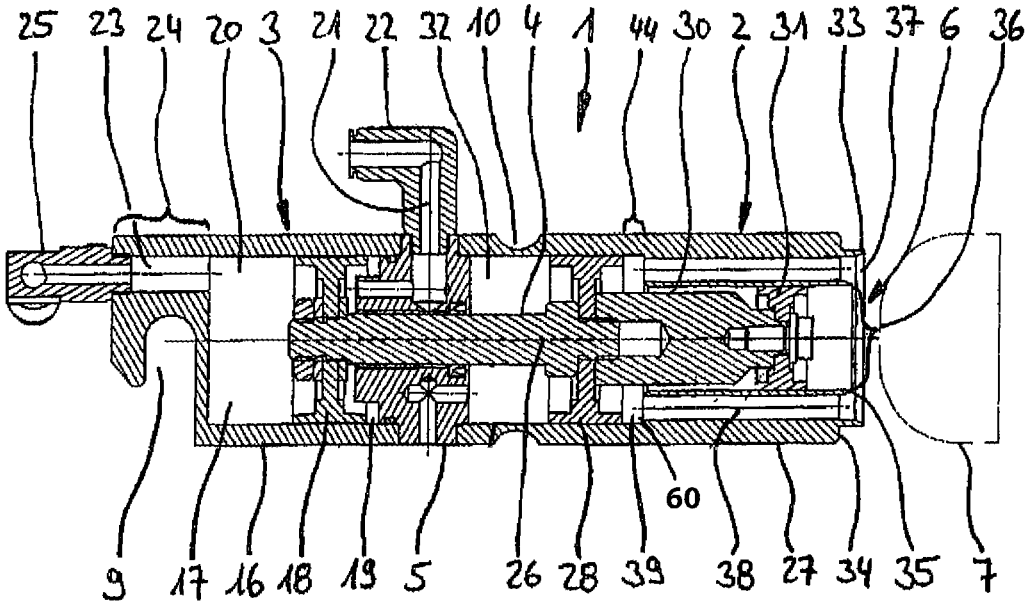
FIG. 5*a* shows a longitudinal section through the vacuum gripper in a starting position along the line V-V in FIG. 4.

According to FIG. 5*a*, the piston-cylinder unit 3 serving as the drive for generating the negative pressure, consists of a cylinder liner 16 and a piston 18 that is supported in the interior 17 thereof in a displaceable and sealed fashion and divides the interior 17 into a first work chamber 19 that faces the partition wall 5 and a second work chamber 20 that is situated on the other side of the piston 18. The work chamber 19 can be acted upon with compressed air through a channel 21 that consists of several sections and is initially situated in a connection piece 22 inserted into the partition wall 5 and then in the partition wall 5 itself. In the partition wall 5, as well as in the connection piece 22, the channel features two sections that extend orthogonal to one another such that the complete channel 21 has the shape of a L. The second work chamber 20 extending in an attachment 24 of the rear section 14 via a channel 23. It also extends in a rear connection piece 25.

The piston-cylinder unit 2 that serves for generating the negative pressure for fixing the loaf 7 is situated on the opposite side of the partition wall 5 coaxial to the piston-cylinder unit 3—referred to a common axis 26. The piston-cylinder unit 2 also consists essentially of a cylinder liner 27, in which a piston 28 is supported in a sliding and sealed fashion. The piston 28 of the piston-cylinder unit 2 and the piston 18 of the piston-cylinder unit 3 have the same diameter and the same stroke due to the coupling by means of the piston rod 4.

Another piston rod 30 that leads to a piston 31 connected thereto is situated on the side of the piston 28 that lies opposite of the piston rod 4. The piston 31 is situated in a section of the cylinder liner 27 in which this liner has a reduced diameter relative to the piston 28 and a work chamber 32 corresponding thereto. The unit consisting of the pistons 28 and 31 (as well as the piston rod 30) therefore represents a step piston that is supported in a correspondingly stepped bore of the cylinder liner 27 in an axially displaceable fashion.

The front side 6 of the vacuum gripper 1 is provided with a closed circular outer blade 33, the wall thickness of which is significantly reduced in comparison with the remaining wall thickness of the cylinder liner 27, wherein the transition from the blade 33 to the remaining wall of the cylinder liner 27 is realized in the form of a radial step 34. The front side 6 of the vacuum gripper 1 is furthermore provided with an inner blade 35 that is also realized circularly and extends concentric to the outer blade 33. In comparison with the front edge of the outer blade 33, the front edge of the inner blade 35 is slightly set back. The inside diameter in the region of the inner blade 35 corresponds to the diameter of the front piston 31 of smaller diameter. The two blades 33 and 35 forms a contact element 29 of the vacuum gripper 1 together with the cylinder liner 27.

The circular cross section formed by the inner blade 35 defines an inner partial suction region 36. The annular region that lays between the inner suction region 36 and the outer blade 33 defines an outer partial suction region 37. Both partial suction regions 36, 37 jointly form the entire effective suction region of the vacuum gripper 1. The outer partial suction region 37 is connected to a right work chamber 39 defined by the piston 28 by means of two bores 38 that are offset relative to one another by 180°. The right work chamber 39 and the bores 38 define steps 60 in the cylinder liner 27.

Figure 5B:
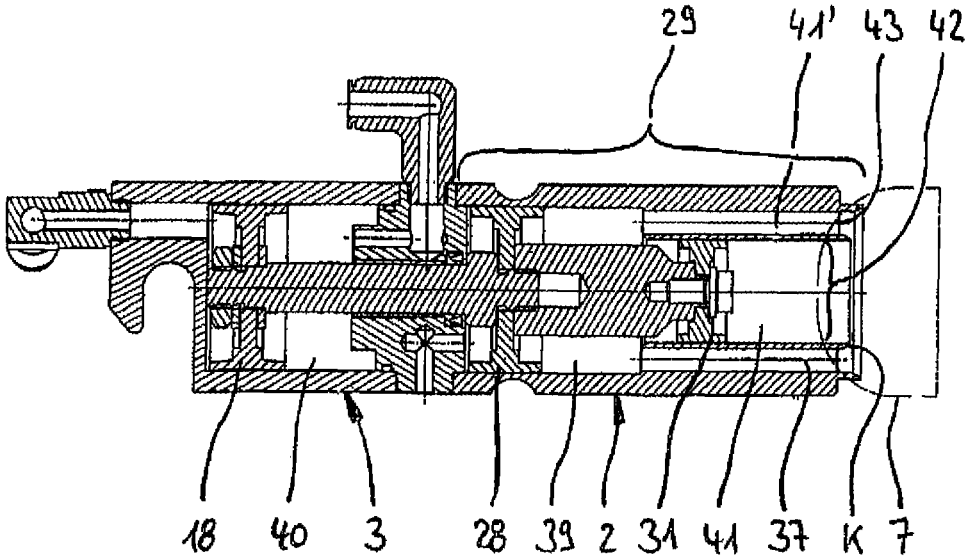
FIG. 5*b* shows a representation analogous to FIG. 5*a* in a negative pressure position.

From the starting position illustrated in FIG. 5*a*, in which both blades 33 and 35 are spaced apart from the end of the loaf 7, the vacuum gripper 1 is moved toward the loaf 7, the opposite front end of which is supported on a conventional cutting device, e.g., in the form of a rotatably driven cut-off knife 70. The approach of the vacuum gripper 1 takes place with a sufficiently high force and to such an extent that the both blades 33 and 35 penetrate into the loaf 7—as shown in FIG. 5*b*. Due to the rounded shape of the end of the loaf 7, the inner blade 35 penetrates deeper than the outer blade 33. The penetrating movement then becomes increasingly difficult and also stops once the loaf 7 is supported in the region of the radial step 34 of the vacuum gripper 1 with its face, wherein this is, however, not yet the case in FIG. 5*b*.

After the two blades 33 and 35 have penetrated into the material of the loaf 7 and thus sealed the two suction regions 36 and 37, the right work chamber 20 of the piston-cylinder unit 3 is acted upon with compressed air such that the two pistons 28 and 31 are displaced toward the left into the position illustrated in FIG. 5*b*. The work chamber 39 that is situated to the right of the piston 28 and a first partial interior 41', as well as a second partial interior 41 that corresponds to the inner partial suction region 36 and is situated in the section of the cylinder liner 27 of reduced diameter, are significantly increased in this fashion such that a negative pressure is generated in the two partial suction regions 36, 37 and reliably fixes the loaf 7 on the vacuum gripper 1. The partial interiors 41, 41' are separated from one another by a contact line K formed by the inner blade 35.

Due to the very effective seal between the partial suction regions 36 and 37 produced by the blades 33 and 35, a single retraction of the pistons 28 and 31, provides for a single negative pressure generation that suffices for permanently ensuring a sufficiently high retaining force. Since the inner partial suction region 36 is completely enclosed by the outer partial suction region 37 and the pressure differential between the two regions therefore is small or ideally zero, the inner partial suction region 36, in particular, is hardly at risk of a vacuum loss. Even if air is admitted into the outer partial suction region 37 past the outer blade 33, a sufficiently high negative pressure is still maintained in the inner partial suction region 36 as long as the inner blade 35 produces an adequate seal.

The inner partial suction region 36 acts upon an inner partial fixing region 42 on the surface of the loaf 7 and the outer partial suction region 37 accordingly acts upon an outer partial fixing region 43 on the surface of the loaf 7. The surfaces of both partial fixing areas 42, 43 add up to the total effective fixing region.

The negative pressures adjusting in the partial suction regions 36 and 37 after a stroke of the driving piston 18 can be influenced with the selection of the diameter of the pistons 28 and 31, the diameter of the piston rod 4 and the diameter and number of bores 38. In this case, it is sensible to choose the negative pressure being generated in the inner partial suction region 36 higher than that in the outer partial suction region 37 because the inner partial suction region 36 is arranged such that it is "protected" by the outer partial suction region 37.

After the loaf 7 has been fixed by activating the vacuum gripper, the loaf 7 can be fed to the cutting device together with the vacuum gripper 1 while slices are successively cut off the front end of the loaf 7. The feed movement is interrupted shortly before the outer blade 33 reaches the effective range of the cut-off knife of the cutting device. A reliable ejection of the remainder of the loaf 7 that still adheres to the vacuum gripper 1 is achieved in that the pistons 28 and 31 are not only retracted into the starting position illustrated in FIG. 5*a* by subjecting the work chamber 20 to pressure via the connection piece 25, but further toward the right by an additional stroke 44 (see FIG. 5*a*) until the piston 28 contacts a step 60 in the cylinder liner 27 resulting from the abrupt change in diameter. This not only causes the pressure in the two partial suction regions 36 and 37 to return to the initial level, i.e., to zero, but also a certain excess pressure to be generated in the two partial suction regions 36 and 37 that actively transports the remainder of the loaf 7 outward, wherein the friction occurring in the region of the blades 33 and 35 needs to be overcome. Subsequently, the pistons 18, 28 and 31 are returned into the starting position illustrated in FIG. 5*a* without the front side 6 of the vacuum gripper contacting a loaf 7 to be cut next in a sealing fashion, i.e., the suction regions 36 and 37 are still under atmospheric pressure. Subsequently, the next gripping and cutting cycle can begin by contacting a new loaf 7.

According to FIG. 6, three vacuum grippers 1 of the type described with reference to FIGS. 1 to 5*b* are arranged adjacent to one another in a parallel fashion in a base frame 45 of a gripping device 46. The crossbars 47 to 49 that form the base frame 45 together with lateral sections 50 and 51 fix the vacuum grippers 1 in the base frame 45 by means of the recesses 9 and 10 illustrated in FIGS. 1 to 3.

The connection pieces 25 and 22 of the respective rear piston-cylinder unit 3 that serve for actuating the front piston-cylinder units 2 for generating the negative pressure are respectively connected in parallel by means of compressed air pipes 52 and 53 such that the negative pressure for the fixing process is always simultaneously generated or neutralized for three adjacently arranged loaves 7 and the residual remains are ejected.

The base frame 45 of the gripping device 46 is known and an identical embodiment thereof serves for accommodating classic, purely mechanical grippers, in which a gripping hook penetrates into the rear end of the loaf 7 with its gripping tines due to a pneumatic actuation, wherein the gripping tines are retracted from the remainder after the cutting process is completed, namely also by means of a pneumatic actuation. Consequently, the existing base frame 45 and the compressed air connections arranged thereon can be used for the vacuum grippers 1, as well as for mechanical grippers with gripping tines that are not illustrated in the figures.

While the invention has been illustrated and described as embodied in a loaf cutting method and apparatus, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A method for cutting a loaf-shaped food, comprising the steps of:

advancing a food loaf toward a cut off knife by a feed apparatus, the feed apparatus including a vacuum gripper, and the advancing of the food loaf including advancing the vacuum gripper;

cutting the food loaf into slices, strips or cubes by the cut off knife;

fixing the food loaf to the vacuum gripper during the advancing of the food loaf, wherein the fixing of the food loaf comprises generating a first negative pressure with a first negative pressure generator and a second negative pressure with a second negative pressure generator within an interior of a contact element of the vacuum gripper, wherein the fixing of the food load further comprises loading of a fixing region of a surface of the food loaf by applying the first negative pressure and the second negative pressure from a suction region of the contact element, wherein the suction region is divided into at least two separate, sealed partial suction regions and the interior of the contact element is divided accordingly into at least two separate, sealed partial interiors that communicate, respectively, with the at least two separate, sealed partial suction regions, wherein the at least two separate, sealed partial suction regions respectively adjoin one another, are separated and sealed from one another by a contact member of the contact element and form separate, sealed partial fixing regions of the surface of the food loaf, and wherein the loading of the fixing region comprises applying the first negative pressure to one of the at least two separate, sealed partial suction regions and applying the second negative pressure to another of the at least two separate, sealed partial suction regions.

2. The method according to claim 1, wherein the first negative pressure and the second negative pressure have the same intensity.

3. The method according to claim 1, wherein one of the at least two separate, sealed partial fixing regions is formed by an inner one of the separate, sealed partial suction regions and is loaded by the first negative pressure of a first intensity, and another one of the at least two separate, sealed partial fixing regions is formed by an adjacent outer one of the separate, sealed partial suction regions that encloses the inner one of the separate, sealed partial suction regions and is loaded by the second negative pressure of a second intensity, wherein the first intensity is higher than the second intensity.

* * * * *